US011300272B1

(12) United States Patent
Zhang et al.

(10) Patent No.: US 11,300,272 B1
(45) **Date of Patent: *Apr. 12, 2022**

(54) LED LAMP WITH ADAPTABLE PLUG-IN PIN CONFIGURATION

(71) Applicant: Green Creative, LTD, Hong Kong (CN)

(72) Inventors: Ryan Zhang, Shanghai (CN); Bertrand Delalande, Shanghai (CN)

(73) Assignee: Green Creative Ltd., Hong Kong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/300,253

(22) Filed: Apr. 30, 2021

(51) Int. Cl.

| | |
|---|---|
| ***F21V 19/00*** | (2006.01) |
| ***F21K 9/272*** | (2016.01) |
| ***H01R 33/74*** | (2006.01) |
| ***F21Y 115/10*** | (2016.01) |

(52) U.S. Cl.
CPC ..... *F21V 19/0005* (2013.01); *F21K 9/272* (2016.08); *F21V 19/001* (2013.01); *H01R 33/74* (2013.01); *F21Y 2115/10* (2016.08)

(58) Field of Classification Search
CPC .... F21V 19/0005; F21V 19/001; F21K 9/272; H01R 33/74
See application file for complete search history.

(56) References Cited

U.S. PATENT DOCUMENTS

| | | | | |
|---|---|---|---|---|
| 5,634,820 | A * | 6/1997 | Vakil | F21V 23/02 315/56 |
| 5,904,415 | A * | 5/1999 | Robertson | F21V 19/008 362/652 |
| 7,097,508 | B1 * | 8/2006 | Yang | F21V 19/0095 439/232 |
| 7,484,980 | B2 * | 2/2009 | Liao | F21V 19/0085 439/236 |

* cited by examiner

*Primary Examiner* — Matthew J. Peerce
(74) *Attorney, Agent, or Firm* — James A. Gavney, Jr.; JAG Patent Services

(57) ABSTRACT

An LED plug-in lamp is disclosed that has a plug head which converts between a G24Q 4-pin plug head and a G24D type 2-pin plug head. The A LED plug-in lamp includes a detachable plug head cap or pin cover that detachably couples to the plug head to thereby form a G24Q 4-pin plug head or is removed from the plug head to thereby from a G24D type 2-pin plug head.

6 Claims, 6 Drawing Sheets

LED LAMP WITH ADAPTABLE PLUG-IN PIN CONFIGURATION

FIELD OF THE INVENTION

This invention is related to lighting. More specifically, this invention is related to light emitting diode plug-in lamps with adaptable contact pin configurations.

BACKGROUND OF THE INVENTION

Plug-in compact fluorescent lamps (CFLs) are plug-in-lamps (PLs) developed with plug-in bases that are attached to fluorescent tubes. The plug-in bases of the CFLs are designed to fit into the matched plug socket of a matched plug-in power outlet to replace traditional incandescent light bulbs. While CFLs last much longer and are more energy efficient than incandescent light bulbs, they are largely being replaced with light emitting diode (LED) PLs.

The plug-in base configuration used for a LED PL can depend on the type of ballasts being used in the fluorescent fixture that is being retrofitted. For example, where magnetic ballasts are being employed, the LED PL need to have a plug-in base with a 2-pin configuration. Where electronic or digital ballasts are being employed, the LED PL needs to have a plug-in base with a 4-pin configuration.

SUMMARY OF INVENTION

The present invention is directed to a LED plug-in lamp. The LED plug-in lamp includes a LED light engine that can have any suitable geometry for the application at hand including, but not limited to, linear, bent and curved geometries. The LED plug-in lamp consists of a plug head with contact pins that are configured to fit into a matched plug socket or matched plug-in power outlet to power the LED light engine. The LED plug-in lamp illustrated herein has a single plug head. However, it will be clear to one skilled in the art that the present invention can have applications for LED plug-in lamps with multiple plug heads.

The LED plug-in lamp of the present invention, includes a LED light engine and a plug head with contact pins that are in electrical communication with the LED light engine through a driver circuit and/or any other suitable electrical circuitry to power or control the LED light engine with the LED plug-in lamp engaged with the matched plug socket or the matched plug-in power outlet. The LED plug-in lamp also includes a plug head cap or pin cover that detachable couples to the plug head. The plug head itself has two fixed and attached contact pins and the plug head cap or pin cover provides two addition contact pins. The plug head cap or pin cover includes all the necessary circuitry to place the two additional contact pins in electrical communication with the LED light engine when the plug head cap or pin cover is attached to the plug head. The present invention allows a LED plug-in lamp to be reversibly converted between a G24D type 2-pin LED plug-in LED lamp and a G24Q-type 4-pin plug-in LED lamp.

A LED plug-in lamp with contact pins that can be retracted or removed from a plug head to convert between G24D type 2-pin plug head configuration to a G24Q 4-pin plug head configuration is described in the patent application Ser. No. 16/501,388 filed Apr. 4, 2019 and titled "LED LAMP WITH ADAPTABLE PLUG-IN PIN CONFIGURATION", now U.S. Pat. No. 10,644,469, the content of which are incorporated by reference.

DETAILED DESCRIPTION OF THE INVENTION

Figure 1A:
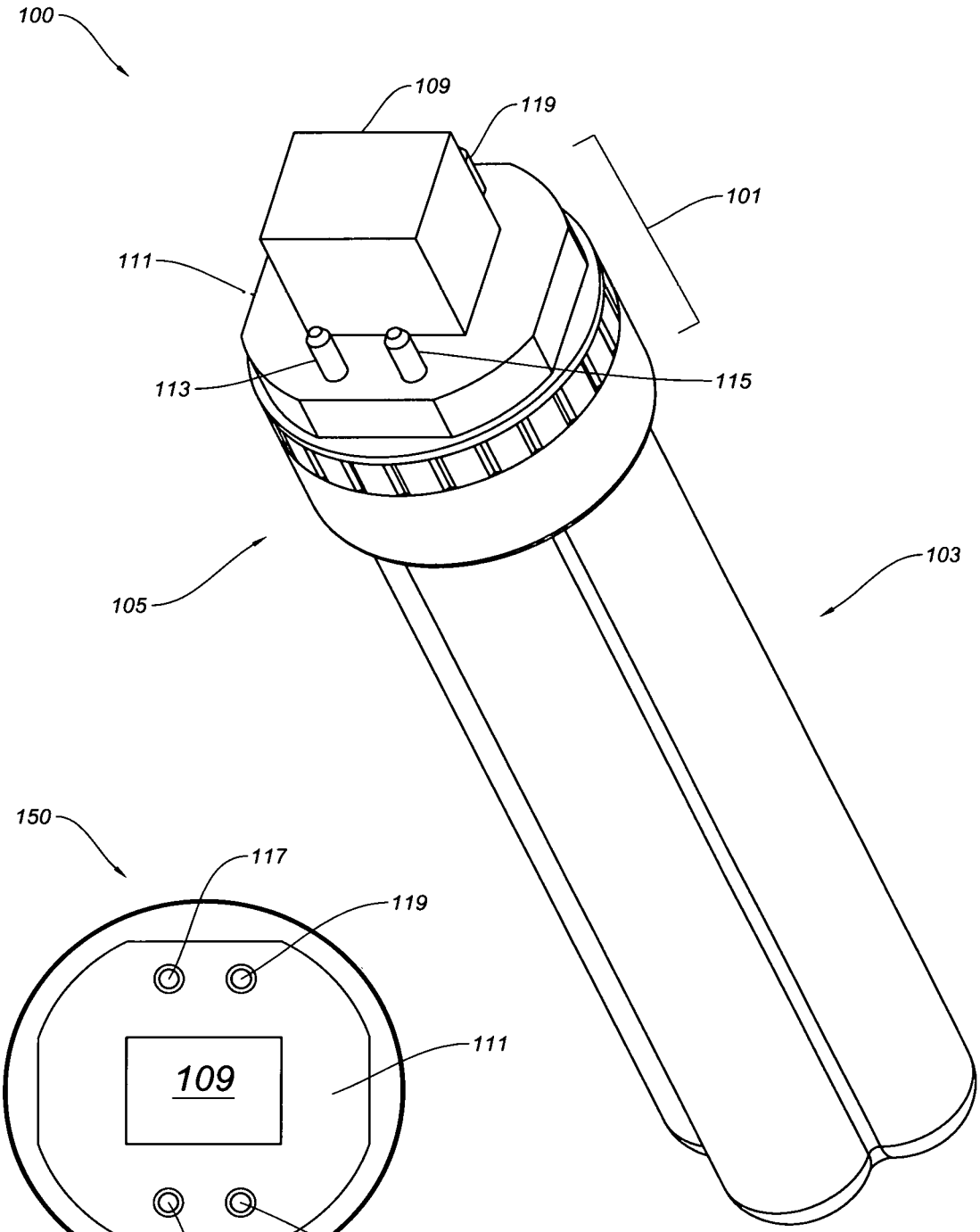
FIGS. 1A-B show a perspective and a top view of an LED plug-in lamp with G24Q 4-pin plug head, respectively.
Figure 1B:
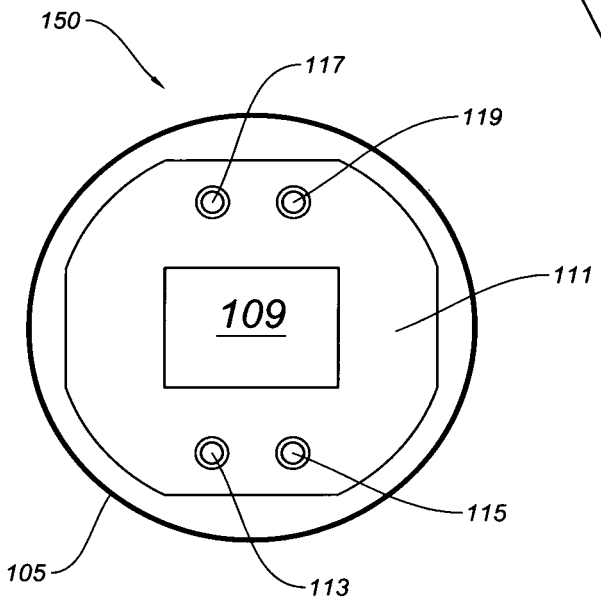

FIGS. 1A-B show a perspective view 100 and top view 150 of an LED plug-in lamp with G24Q 4-pin plug head 101. The plug head 101 is electrically coupled to an LED light engine 103 through circuitry and wiring, including, but not limited, to LED divers and LED dimmer drivers. The plug head 101 has four contact pins 111, 115, 117 and 119 protruding from a top surface of a stage structure 111. The stage structure includes a protruding fitted insert 109 that along with the flour contact pins 113, 115, 117 and 119 fit into a matched G24Q plug-in socket or power outlet for powering the LED plug-in lamp. Attached to a bottom portion of the stage structure 111 there is a collar structure or housing structure 105 that can house necessary wiring or circuitry.

Figure 2A:
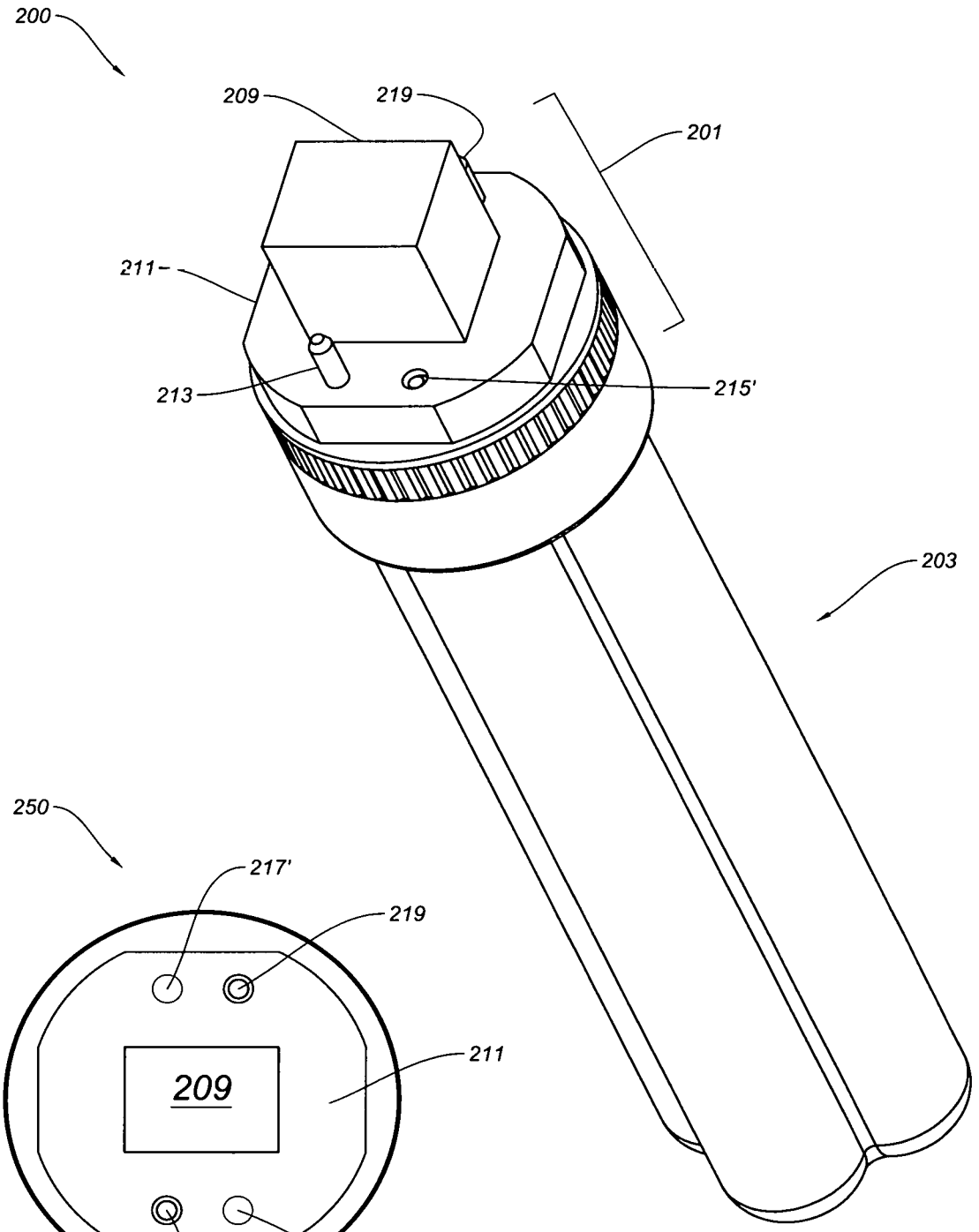
FIGS. 2A-B show a perspective and a top view of an LED plug-in lamp with G24Q 4-pin plug head that has been converted to a G24D 2-pin plug head, in accordance with the embodiments of the invention.
Figure 2B:
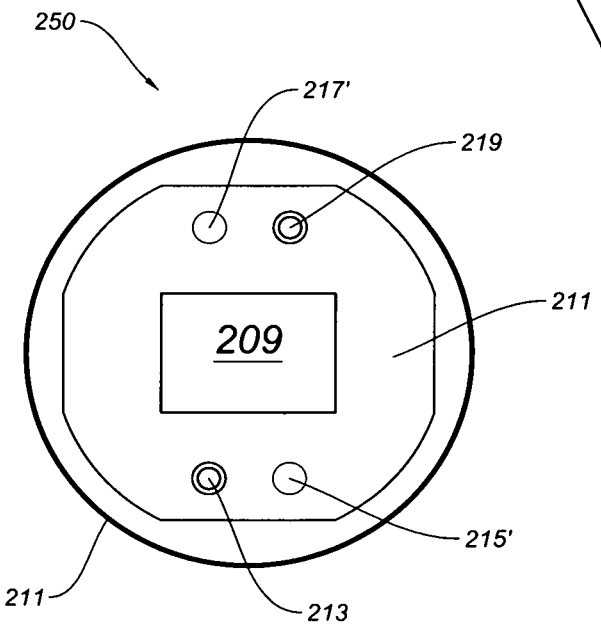

FIGS. 2A-B show a perspective view 200 and top view 250 of an LED plug-in lamp with G24Q 4-pin plug head 201 that has been converted to a G24D 2-pin plug head. As described above, the plug head 201 is electrically coupled to an LED light engine 203. The plug head 201 has 2 contact pins 213 and 219 protruding from a fixed or stationary stage structure 211 along with a protruding fitted insert 209. The plug head 201 is configured to fit into a matched G24D 2-pin plug-in socket or power outlet for powering the LED plug-in lamp 200. As shown, two contact pins have been removed from the pin apertures 215' and 217'. In accordance with the present invention additional contact pins are removed or added to the plug head of the LED plug-in lamp via a plug head cap or pin cover, as described in detail below.

Figure 3A:
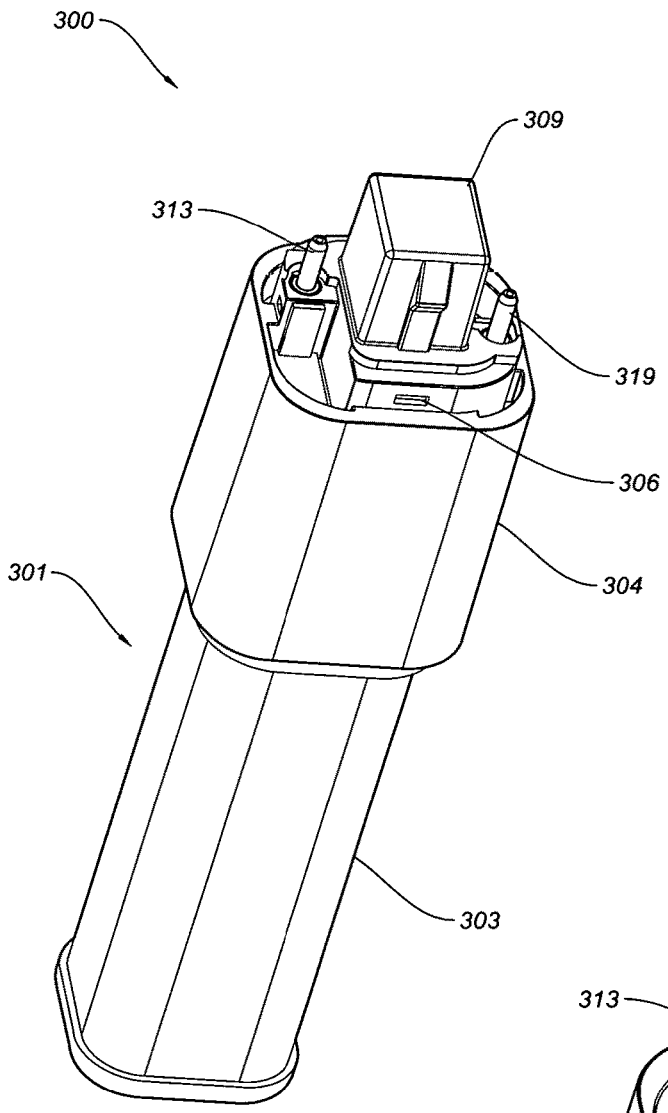
FIGS. 3A-B illustrate schematic representations of an LED plug-in lamp with and open plug head having two attached contact pins.
Figure 3B:
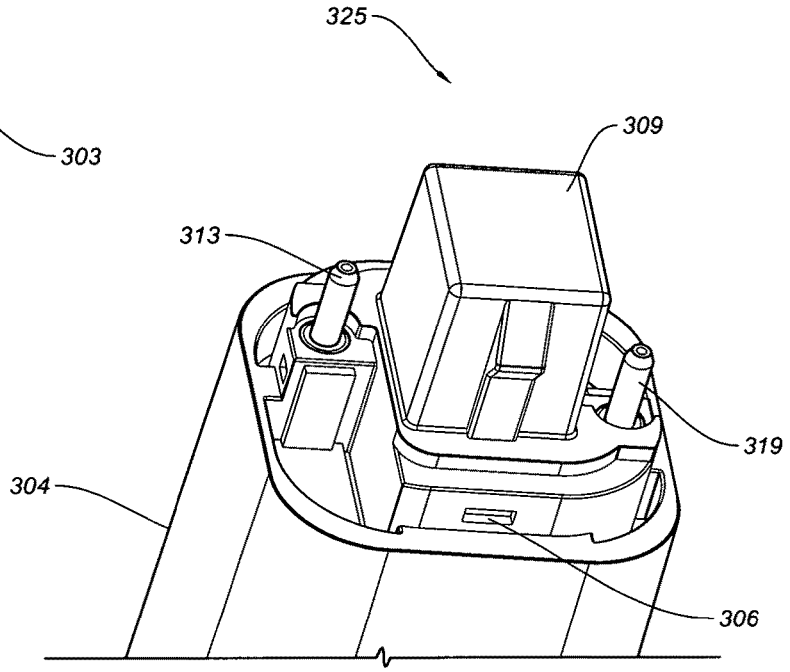

FIGS. 3A-B illustrate schematic representations 300 and 325 of a LED plug-in lamp 301 with a light engine 303 and open plug head 304 having two contact pins 331 and 319 attached thereto. The open plug head 304 is generated by removing a cover structure (not shown).

To convert the plug head 304 of the LED plug-in lamp 301 from a 2-pin plug head to a 4-pin plug head, a cover or cap (not shown) is removed and replaced with a plug head cap or pin cover 501 with two additional contact pins 415 and 417 having the appropriate circuit to allow the additional contact pins to function, such as described below. The plug head cap or pin cover 501 has two contact pin holes 413 and 419 and square or rectangular cut-out 402 that the contact pins 313/319 and a protruding fitted insert 309 fit into. The 4-pin plug head can be converted back to a 2-pin plug head by removing the plug head cap 501 and replacing the original cover or cap.

Figure 4A:
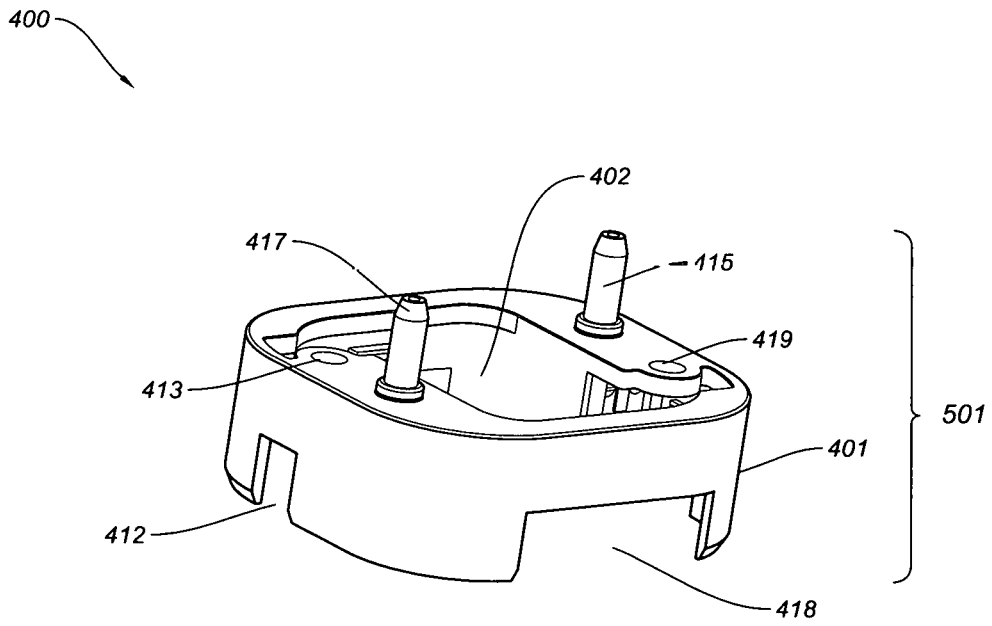
FIGS. 4A-B illustrate schematic representations of plug head cap with two additional contact pins for converting a two contact pin plug head into a four contact pin plug head, in accordance with the embodiments of the invention.
Figure 4B:
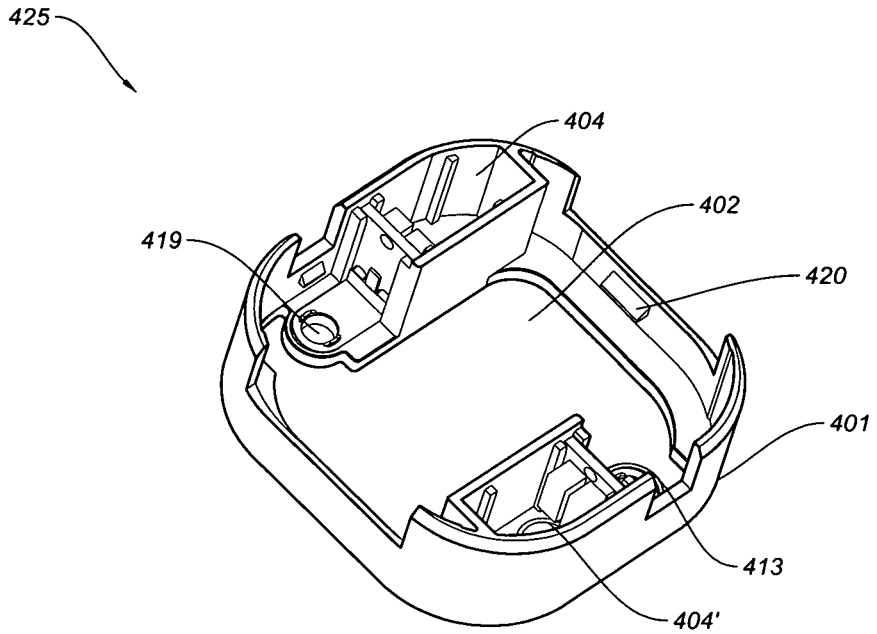

FIGS. 4A-B illustrate schematic representations of the plug head cap or pin cover 501 with the two additional contact pins 415 and 417 for converting a 2-pin plug head into a 4-pin plug head, in accordance with the embodiments of the invention. The plug head cap or pin cover 501, as shown, has a body portion 401. The body portion 401 is formed with contours 412/418, a cut out 402 and contact pin receiving holes 413 and 419 that allow the plug head cap or pin cover 501 to be fitted onto and over the contact pins 313/319 and the protruding fitted insert 309. The plug head cap or pin cover 501 is formed with any number of clip or snap features 420 and 420' that engaged matched groove or snap features 306 on the plug head 304. It will be clear to one skilled in the art that any number of mechanisms can be used to secure the plug head cap 501 onto the plug head 304 including, but not limited to, compression fittings, screws and other two-part snap features. The plug head cap or pin cover 501 also includes all of the necessary electrical contact circuitry to enable the additional contact pins 415 and 417 to operate and power the LED plug-in lamp 301 when the plug head cap or cover 501 is installed onto the plug head 304 of the LED plug-in lamp 301. The electrical circuitry can be housed in open or closed compartments 404 and 404' of the plug head cap or cover 501.

Figure 5A:
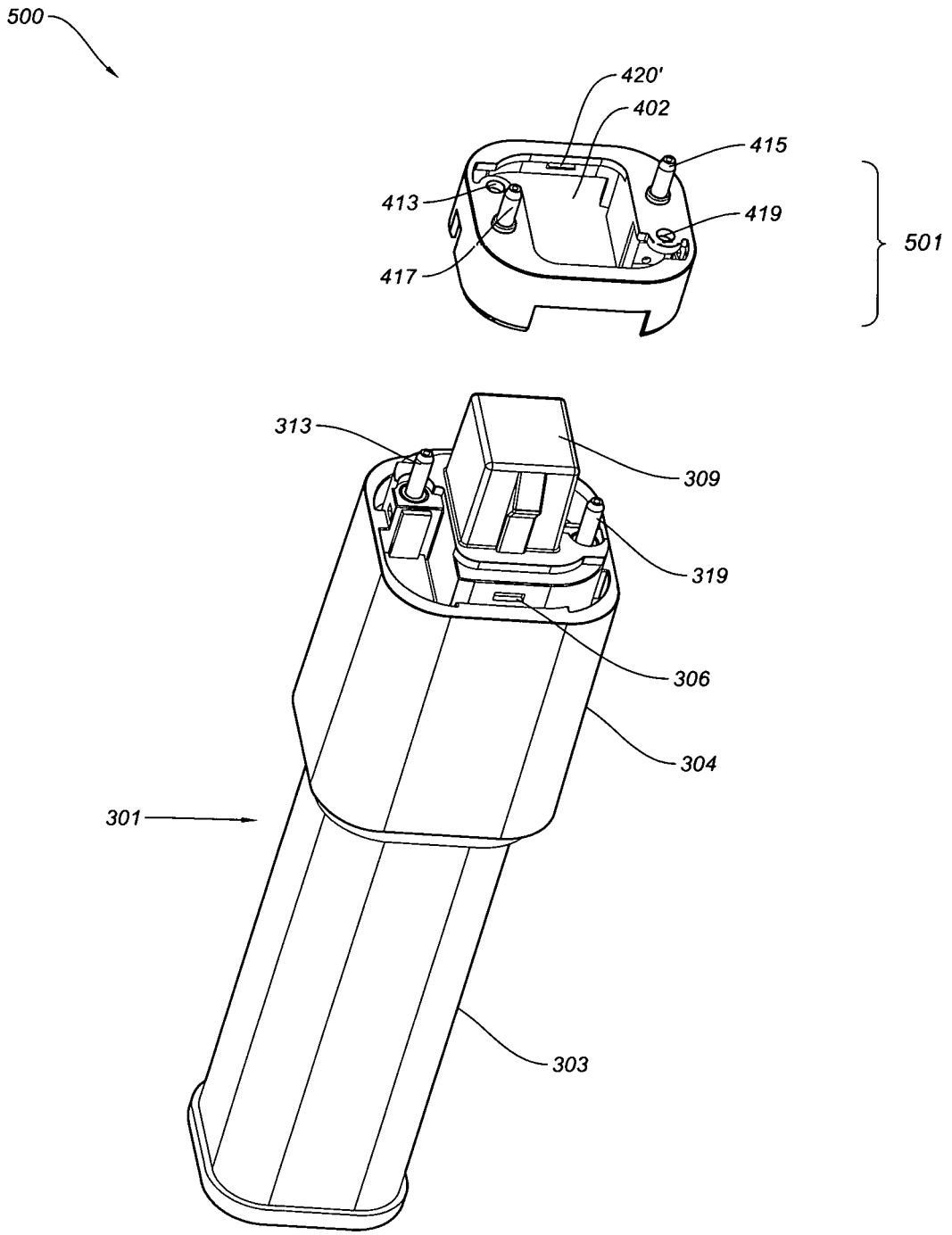
FIGS. 5A-B illustrate attaching the plug head cap structure shown in FIGS. 4A-B to a LED plug-in lamp with a two pin plug in head to convert the LED plug-in lamp from having a G24D 2-pin type plug head to having a G24Q 4-pin type plug head, in accordance with the embodiments of the invention.
Figure 5B:
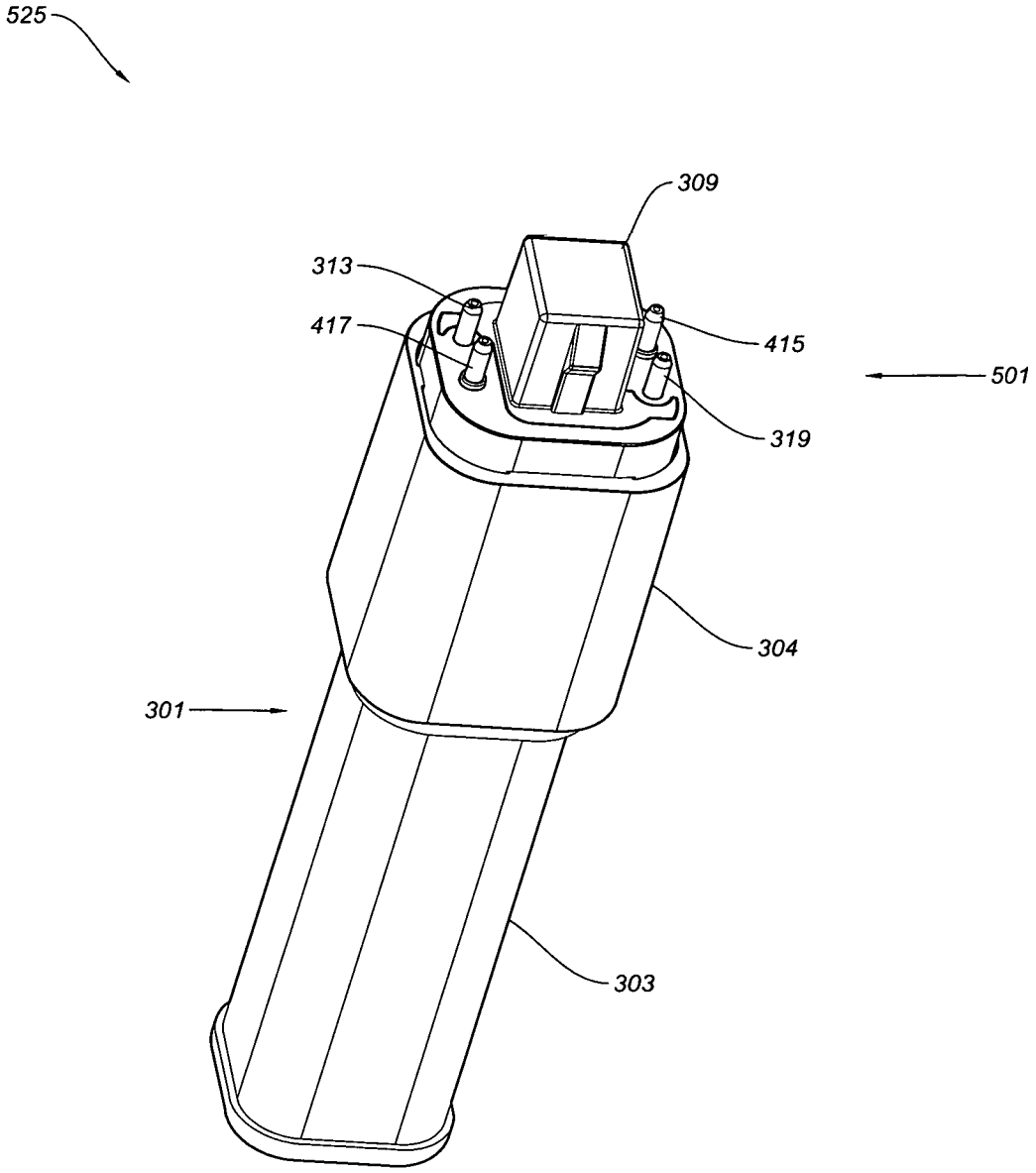

FIGS. 5A-B illustrates a view 525 of the plug head cap or pin cover 501 shown in FIGS. 4A-B installed on the plug head 304 of the LED plug-in lamp 301. With the plug head cap or pin cover 501 installed on the LED plug-in lamp 301 as shown, the LED plug-in lamp 301 has a 4-contact pin configuration for powering the light engine 303 as a G24Q 4-pin LED plug-in lamp 301 when the LED plug-in lamp 301 is plugged into an appropriate power receptacle.

The present invention has been described in terms of specific embodiments incorporating details to facilitate the understanding of the principles of construction and operation of the invention. It will be apparent to those skilled in the art that modifications can be made in the embodiments chosen for illustration without departing from the spirit and scope of the invention.

What is claimed is:

1. An LED plug-in lamp comprising:

a) an LED light engine; and b) a plug head with two contact pins in electrical communication with the LED light engine and c) a plug head cap or pin cover with two additional contact pins and that detachably couples to the plug head to place the two additional contact pins in electrical communication with the LED light engine and reversibly convert the plug head of the LED plug-in lamp between a G24D type 2-pin plug head and a G24Q-type 4-pin plug head.

2. The LED plug-in lamp of claim 1, wherein the plug head cap or pin cover includes electrical contact circuitry to place the two additional contact pins in electrical communication with the LED light engine.

3. The LED plug-in lamp of claim 2, wherein the plug head cap or pin cover includes an attachment mechanism for detachably coupling to the plug head.

4. The LED plug-in lamp of claim 3, where in the attachment mechanism includes clip features that engage matched groove or snap features on the plug head.

5. An LED plug-in lamp comprising:

a) an LED light engine;

b) a plug head with four contact pins that protrude from the plug head and are in electrical communication with the LED light engine; and c) a plug head cap couples to the plug head that is capable of being removed along with two of the four contact pins that are attached to the plug head cap to thereby convert the plug head from a G24Q-type 4-pin plug head to a G24D type 2-pin plug head.

6. An LED plug-in lamp comprising:

a) an LED light engine;

b) a plug head with two contact pins that are attached to and that protrude from the plug head and that are in electrical communication with the LED light engine; and c) a plug head cap with two additional contact pins and that couples to the plug head thereby placing the two additional contact pins in electrical communication with LED light engine and thereby convert the plug head from a G24Q-type 2-pin plug head to a G24D type 4-pin plug head.

* * * * *